US008779882B2

(12) United States Patent
Phadke

(10) Patent No.: US 8,779,882 B2
(45) Date of Patent: Jul. 15, 2014

(54) CENTER TAPPED TRANSFORMERS FOR ISOLATED POWER CONVERTERS

(75) Inventor: Vijay G. Phadke, Pasig (PH)

(73) Assignee: Astec International Limited, Kwun Tong, Kowloon (HK)

( * ) Notice: Subject to any disclaimer, the term of this patent is extended or adjusted under 35 U.S.C. 154(b) by 353 days.

(21) Appl. No.: 12/570,105

(22) Filed: Sep. 30, 2009

(65) Prior Publication Data

US 2011/0074533 A1 Mar. 31, 2011

(51) Int. Cl.

| | |
|---|---|
| ***H01F 27/28*** | (2006.01) |
| ***H01F 21/12*** | (2006.01) |
| ***H01F 5/00*** | (2006.01) |
| ***H01F 27/24*** | (2006.01) |
| ***H01F 17/04*** | (2006.01) |

(52) U.S. Cl.

USPC ..... 336/180; 336/150; 336/182; 336/200; 336/212; 336/220; 336/221; 336/232

(58) Field of Classification Search

USPC ..... 336/150, 200, 212, 220, 221, 232, 180, 336/182

See application file for complete search history.

(56) References Cited

U.S. PATENT DOCUMENTS

| | | | | |
|---|---|---|---|---|
| 5,684,445 | A * | 11/1997 | Kobayashi et al. | 336/83 |
| 7,199,569 | B1 * | 4/2007 | Nakahori | 323/355 |
| 2004/0222873 | A1 * | 11/2004 | Toyomura | 336/182 |
| 2005/0047175 | A1 * | 3/2005 | Kawasaki et al. | 363/16 |
| 2005/0242916 | A1 * | 11/2005 | So | 336/200 |
| 2008/0212341 | A1 * | 9/2008 | Moiseev | 363/21.04 |
| 2008/0218300 | A1 * | 9/2008 | Loef et al. | 336/58 |
| 2008/0224812 | A1 * | 9/2008 | Chandrasekaran | 336/212 |
| 2009/0237195 | A1 * | 9/2009 | Zeng et al. | 336/196 |

* cited by examiner

*Primary Examiner* — Tsz Chan

(74) *Attorney, Agent, or Firm* — Harness, Dickey & Pierce, P.L.C.

(57) ABSTRACT

A cost effective solution for construction of high frequency, double ended, isolated, push pull, center tapped power transformers operating in continuous/discontinuous mode with minimized winding proximity losses comprises at least two identical sets of windings with identical coupling coefficients. Each set of windings consists of at least one primary winding and at least one secondary winding tightly coupled to each other. Both the sets of windings are loosely coupled to each other with a magnetic field isolating separator.

19 Claims, 6 Drawing Sheets

CENTER TAPPED TRANSFORMERS FOR ISOLATED POWER CONVERTERS

FIELD

The present disclosure relates to the field of transformers. In particular, this disclosure relates to center tapped transformers.

BACKGROUND

This section provides background information related to the present disclosure which is not necessarily prior art.

Many double ended power conversion topologies employ either a center tapped primary with two low sided switches (connected to the neutral/earth) or a single primary with power switches configured in half bridge (2 transistors drive) or full bridge (4 transistors drive) configuration. However, all of these circuits employ full wave rectification on the secondary side. If the output voltage is high, then bridge rectification is provided with only a single secondary winding. However, for converters which have low output voltage but high output current, bridge rectification results in higher conduction losses. Accordingly, a center tapped full wave rectifier is used due to lower conduction losses in only one rectifier during each half cycle. To keep the voltage spikes and losses lower, the transformer is designed to have a low leakage inductance.

A prior art half bridge push-pull converter system 100 that operates in a continuous conduction mode is illustrated in FIG. 1. FIG. 3 illustrates a topology used in the construction of prior art center tapped transformers operating in continuous conduction mode converters as illustrated in FIG. 1. The primary winding of a transformer is split into two parts represented by Np1 and Np2 and the two secondary windings represented by Ns1 and Ns2 are sandwiched between the two parts of the primary winding Np1 and Np2. This construction offers a good coupling between each secondary and primary while the two secondary windings Ns1 and Ns2 are coupled to each other as well to keep commutation period after dead time or "duty cycle loss" as low as possible. Some times, the two secondary windings also use bi-filar winding technique to improve their coupling.

Another power conversion topology 200 used in prior art is illustrated in FIG. 2. The system 200 is a prior art LLC resonant converter that operates in a discontinuous conduction mode. FIG. 4 illustrates a topology used in prior art to reduce coupling between the two secondary windings of the center tapped transformer operating in a discontinuous conduction mode as illustrated in FIG. 2. In this construction, the primary winding is sandwiched between two secondary windings. Although the two secondary windings are decoupled from each other to a large extent, the non conducting secondary still experiences the current field created by the primary winding adjacent to it. Thus the proximity losses due to eddy current still exist.

Various techniques have been used to provide a practical and cost effective transformer construction that offers a tight and equal coupling of each secondary winding with the primary winding to reduce the winding proximity losses.

SUMMARY

This section provides a general summary of the disclosure, and is not a comprehensive disclosure of its full scope or all of its features.

According to one aspect of this disclosure, a high frequency, double ended, isolated, push pull, center tapped power transformer includes at least two identical sets of windings, said sets of windings having identical number of turns and structure to achieve identical coupling coefficients, said sets of windings being spaced apart from each other, each of said sets of windings comprising at least one primary winding and at least one secondary winding, said primary winding(s) being very tightly coupled to said secondary winding(s) by placing the primary and secondary windings abutting each other; and a magnetic field isolating separator placed in the space between said sets of windings.

According to another aspect of this disclosure, a method of construction of a high frequency, double ended, isolated, push pull, center tapped power transformer is disclosed. The method includes winding the transformer windings on a bobbin to form a plurality of primary windings; winding the transformer windings on a bobbin to form a plurality of secondary windings; and arranging the primary and secondary windings to form sets of primary and secondary windings such that the primary and secondary windings in each of said sets are abutting each other and said sets of windings are spaced apart with reference to each other using a magnetic field isolating separator provided between said sets of windings.

According to yet another aspect of this disclosure, a center tapped transformer for an isolated power converter is disclosed. The transformer includes a first primary winding and a second primary winding galvanically connected in parallel with the first primary winding. The transformer includes a first secondary winding and a second secondary winding galvanically connected to the first secondary winding. The first primary winding is electromagnetically coupled to the first secondary winding. The second primary winding is electromagnetically coupled to the second secondary winding. The first primary winding is weakly electromagnetically coupled to the second primary winding.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes of selected embodiments only and are not intended to limit the scope of the present disclosure.

Corresponding reference numerals/indicia indicate corresponding parts throughout the several views of the accompanying drawings.

DETAILED DESCRIPTION

Figure 1:
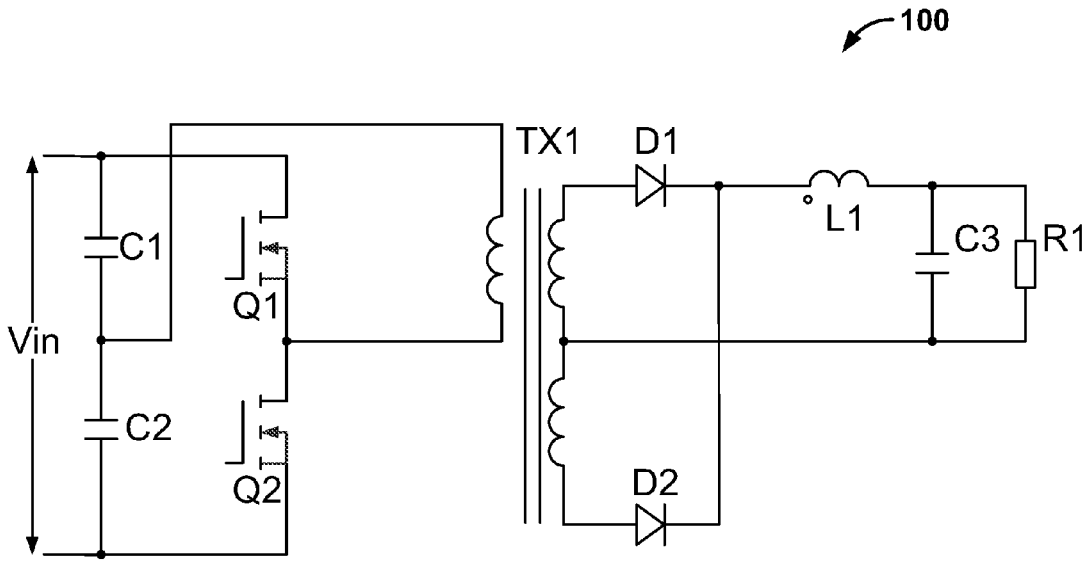
FIG. 1 (Prior Art)
FIG. 1 illustrates a prior art half bridge push-pull converter that operates in a continuous conduction mode.
Figure 2:
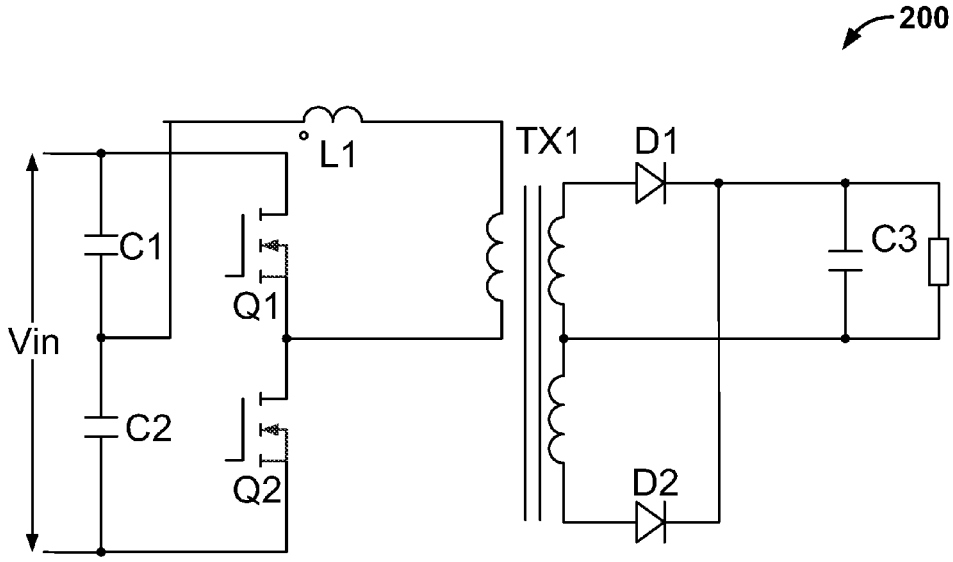
FIG. 2 (Prior Art)
FIG. 2 illustrates a prior art LLC resonant converter that operates in a discontinuous conduction mode.
Figure 3:
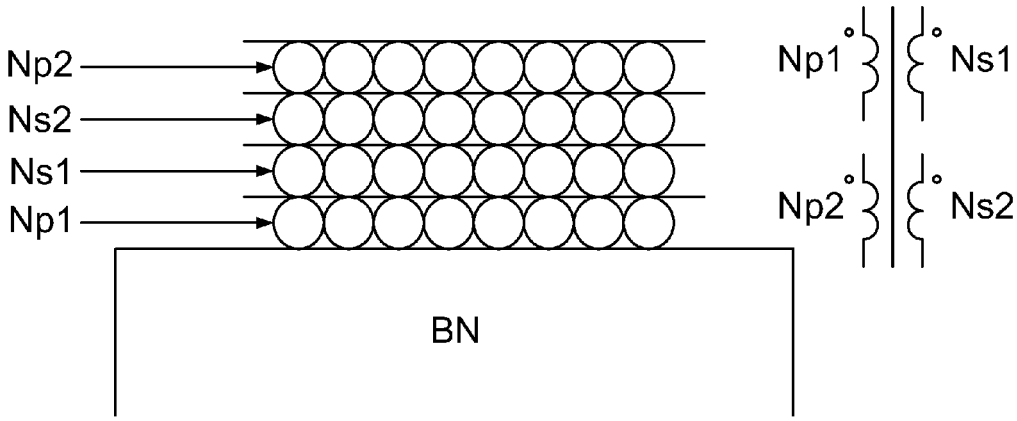
FIG. 3 (Prior Art)
FIG. 3 illustrates a topology used in the construction of prior art center tapped transformers operating in continuous conduction mode converters as illustrated in FIG. 1.
Figure 4:
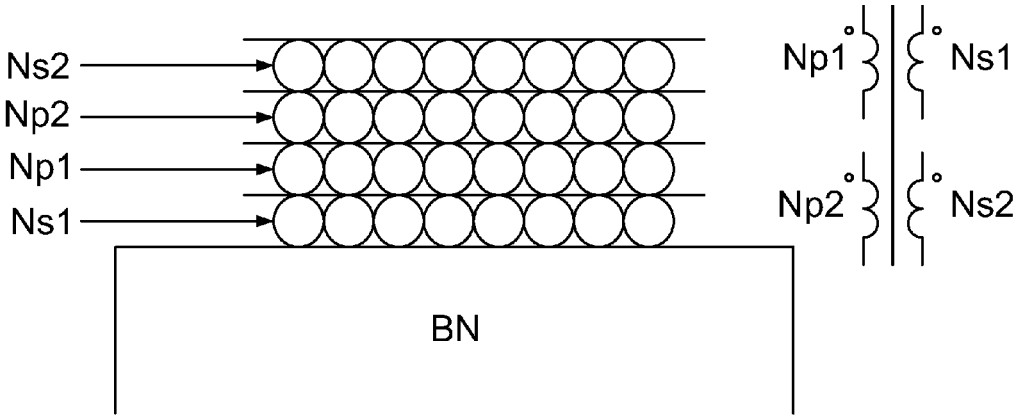
FIG. 4 (Prior Art)
FIG. 4 illustrates a topology used in the construction of prior art center tapped transformers operating in discontinuous conduction mode converters as illustrated in FIG. 2.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

According to one aspect of this disclosure, a center tapped transformer for an isolated power converter is disclosed. The transformer includes a first primary winding and a second primary winding galvanically connected in parallel with the first primary winding. The transformer includes a first secondary winding and a second secondary winding galvanically connected to the first secondary winding. The first primary winding is electromagnetically coupled to the first secondary winding. The second primary winding is electromagnetically coupled to the second secondary winding. The first primary winding is weakly electromagnetically coupled to the second primary winding.

The first primary winding of the transformer may be weakly electromagnetically coupled to the second secondary winding and the second primary winding may be weakly electromagnetically coupled to the first secondary winding.

A transformer according to the aspect disclosed above may be used in any suitable isolated power converter including, for example, a converter having a push-pull topology using center tapped windings for output rectification and having discontinuous current in the secondary windings. More specifically, such a transformer may be used in, for example, an LLC resonant converter, a fixed frequency resonant bus converter, a forced resonant bus converter, etc.

When used in an appropriate converter, in each half cycle of operation, the primary winding that is coupled tightly to the conducting secondary winding takes most of the reflected load current. For example, during one half cycle the first primary winding takes most of the load current when the first secondary winding is conducting. At such time, other primary winding (e.g., the second primary winding), which is coupled to the non-conducting secondary winding (e.g., the second secondary winding) does not see much of the load current and shares only the magnetizing current with the first primary winding. As a result, the current in each of the first primary winding and second primary winding is discontinuous with a large DC component in it. As there is no current field around the non conducting secondary winding, it may not experience appreciable proximity losses due to induced eddy currents. In addition to reduced proximity losses, power losses in a transformer according to the aspect described above may be lower than conventional transformers due to the significant DC current component. Additionally, such a construction allows using thicker wire gauge.

The transformer may also include an isolator positioned between the first primary winding and the second primary winding. The isolator reduces electromagnetic coupling between the first primary winding and the second primary winding. The isolator may be made from any suitable material in any suitable material including, for example, margin tape wound between the first and second primary windings, an extension of a bobbin of the transformer between the first and second primary windings, etc.

The first primary winding and the second primary winding of the transformer may each include a first subwinding and a second subwinding. The first subwinding of each primary winding may connected in parallel with its primary winding's second subwinding. In such embodiment, each subwinding may have the same number of turns as is desired for that primary winding overall. Alternatively, the subwindings of a primary winding may be connected in series. When series connected, the total number of turns of the first and second subwindings is the same number of turns as is desired for that primary winding overall. In some embodiments, the first and second subwindings each have one half of the total number of turns desired for that primary winding.

The physical construction of the transformer with the primary windings including subwindings may include a sandwiched winding construction. The first secondary winding may be physically sandwiched between the first subwinding and the second subwinding of the first primary winding and the second secondary winding may be sandwiched between the first subwinding and the second subwinding of the second primary winding.

Without limiting the aspects and/or embodiments discussed above, further embodiments of the present disclosure, which may or may not include one or more aspect discussed above, will be discussed hereinafter The constructional aspects of transformers are typically modified in the areas of core construction, winding topology and cooling arrangements depending on specific requirements.

The present disclosure focuses on winding topology and envisages a cost effective solution for the construction of high frequency, double ended, isolated, push pull, center tapped power transformers operating in continuous/discontinuous mode with minimized winding proximity losses. In accordance with the present disclosure, the transformer comprises at least two identical sets of windings with identical coupling coefficients. Each set of windings consists of at least one primary winding and at least one secondary winding tightly coupled to each other. Both the sets of windings are loosely coupled to each other with a magnetic field isolating separator.

Transformer windings are typically wound on a bobbin made of a suitable cross section and are of concentric type (the primary and secondary coils are wound concentrically to cover the entire surface of the core) or sandwich winding type (at least one of the windings is split into at least two parts and sandwiched, the split sections are preferred to be identical, though not necessary). The sandwich winding has a distinct advantage that the leakage inductance can be adjusted by splitting the windings suitably.

A topology for construction of center tapped transformers in accordance with the present disclosure is illustrated and described herein with reference to FIG. 5 to FIG. 10.

Figure 5:
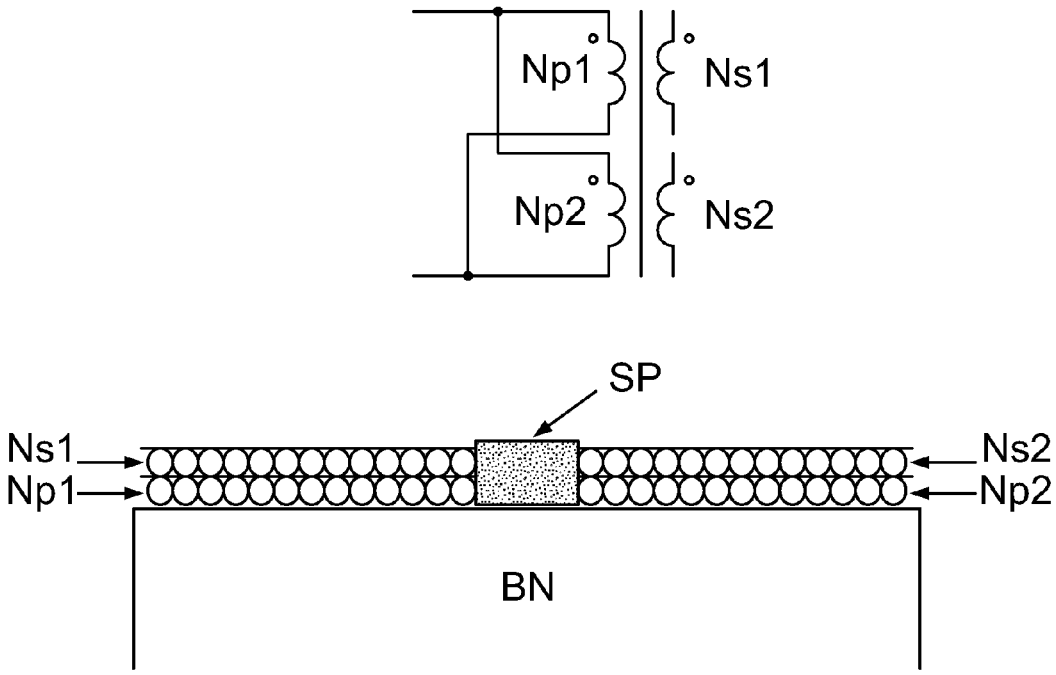
FIG. 5 illustrates a topology for construction of center tapped transformers operating in continuous/discontinuous conduction mode converters in accordance with the present disclosure.

In accordance with the present disclosure, at least two identical sets of windings are provided with identical number of turns and structure and preferably selected from the same manufactured batch to achieve identical coupling coefficients. The structure of a winding typically includes specifications for thickness, conductivity, material, current carrying capacity and the like for a winding. The winding placement of a concentric transformer constructed using a bobbin and ferrite core geometry such as EE, PQ, ETD and the like, is illustrated in FIG. 5, wherein a topology for the construction of center tapped transformers operating in continuous/discontinuous conduction mode converters is shown. As illustrated in FIG. 5, each set of windings includes at least one primary winding (represented by Np1 or Np2) and at least one secondary winding (represented by Ns1 or Ns2). Both primary windings Np1 and Np2 are provided with number of turns as required for the design. The two secondary windings provide a rectified output (using diodes not shown) and have number of turns as required for the application. The two primary windings Np1 and Np2 are connected in parallel.

The windings Np1 and Ns1 are separated from the windings Np2 and Ns2 with a winding separator SP. The separator SP is a magnetic field isolator. The width of the separator depends upon the safety spacing requirement. In an off-line power supply which uses triple insulated wires for primary, this width can be quite narrow. Such separators can be a few layers of a narrow margin insulating tape, typically about 2 mm wide. The width of an electrical insulator used as a separator can vary depending upon the degree of decoupling needed between the two identical sets of windings in a given application. Alternatively, the bobbin design can be extended to include a thin wall that serves to be a magnetic field isolator between the sets of windings. This is common in bobbins designed for winding common mode chokes. Several alternative topologies are possible to achieve the same results.

The separator SP creates two sections in the bobbin. The bobbin base is represented by BN. The primary winding Np1 and the secondary winding Ns1 are wound in one of the sections in such a way as to maximize the coupling between the two windings. Standard winding techniques are used. The primary winding Np2 and the secondary winding Ns2 are wound identically in the other section. Insulation tapes are used according to isolation needs and the winding is completed.

In accordance with the present disclosure, the primary winding Np1 and the secondary winding Ns1 have a good coupling with each other. At the same time, the primary winding Np2 and the secondary winding Ns2 also have an equally good coupling with each other. If needed, this coupling is further improved by using sandwich winding technique. However, the primary winding Np1 and the secondary winding Ns1 have a very poor coupling with respect to the primary winding Np2 and the secondary winding Ns2 and vice versa. Similarly, the primary windings Np1 and Np2 also have very poor coupling with each other.

When the secondary winding Ns1 is properly polarized and starts to deliver output current, the primary winding Np1 takes up most of the primary reflected current. This happens because the primary winding Np2 has very poor coupling with the secondary winding Ns1 and cannot compete with the primary winding Np1 for sharing the primary current. However, both the primary windings Np1 and Np2 share the magnetizing current equally. As a result, the non conducting secondary winding Ns2 does not have much field around it, as its adjacent primary winding Np2 is carrying only the magnetizing current. Thus it does not experience any appreciable proximity loss due to the induced eddy currents. The same phenomenon occurs in the other half cycle when the secondary winding Ns2 is delivering the load current and the secondary winding Ns1 is the non conducting winding. The non conducting secondary does not have much electric field around it and this also shows a large DC component of current in primary which significantly reduces the AC losses as well and allows use of thicker wire to reduce DC current related losses.

Figure 6:
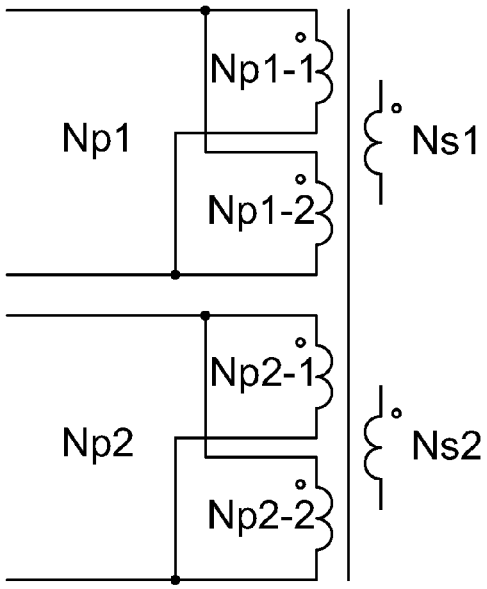
FIG. 6 illustrates a winding connection for center tapped transformers operating in continuous/discontinuous conduction mode converters in accordance with the present disclosure.
Figure 7:
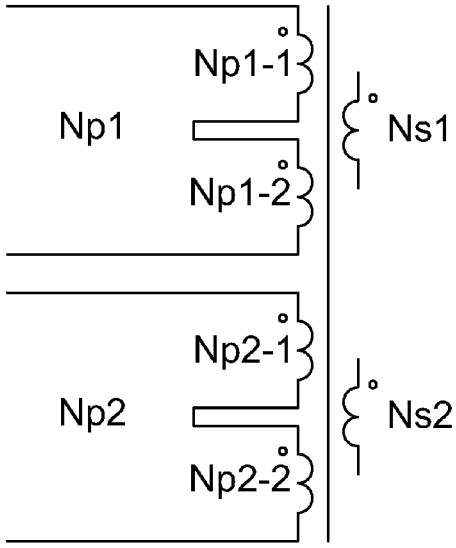
FIG. 7 illustrates an alternative winding connection for center tapped transformers operating in continuous/discontinuous conduction mode converters in accordance with the present disclosure.

This elimination of proximity losses in accordance with the present disclosure is achieved by making minor practical variations in the winding styles as illustrated in FIG. 6 and FIG. 7. In FIG. 6 & FIG. 7, each primary winding (Np1 and Np2) is split into two windings for parallel or series combinations. The primary winding Np1 is split into Np1-1 and Np1-2 and the primary winding Np2 is split into Np2-1 and Np2-2.

FIG. 6 illustrates a winding connection in accordance with the present disclosure, wherein each of the windings Np1-1 and Np1-2 have same number of turns as in Np1 and are connected in parallel to form Np1. Each of the windings Np2-1 and Np2-2 have same number of turns as in Np2 and are also connected in parallel to form Np2.

FIG. 7 illustrates an alternative winding connection in accordance with the present disclosure, wherein each of the windings Np1-1 and Np1-2 have half the number of turns as in Np1 and are connected in series to form Np1. Each of the windings Np2-1 and Np2-2 have half the number of turns as in Np2 and are also connected in series to form Np2.

Similarly, Np1 and Np2 can be split in many different ways to improve the leakage inductance of each section if desired.

Figure 8:
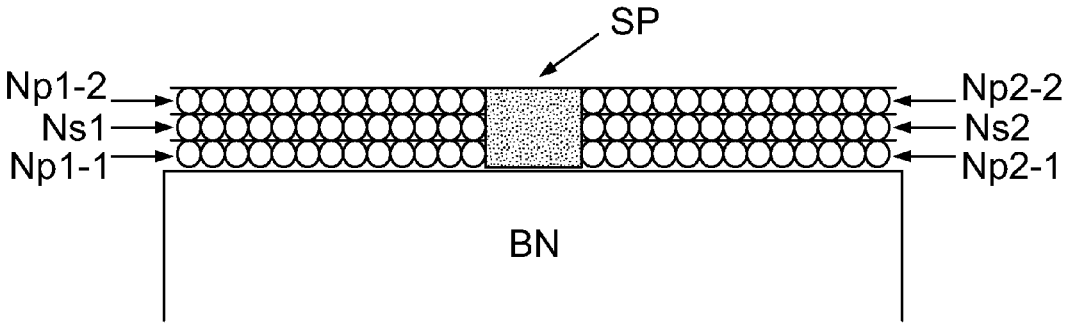
FIG. 8 illustrates a topology for construction of center tapped transformers operating in continuous/discontinuous conduction mode converters in accordance with the winding connections illustrated in FIG. 6 and FIG. 7.

FIG. 8 illustrates a topology for construction of center tapped transformers operating in continuous/discontinuous conduction mode converters in accordance with the winding connections illustrated in FIG. 6 and FIG. 7 and described herein above.

Figure 9:
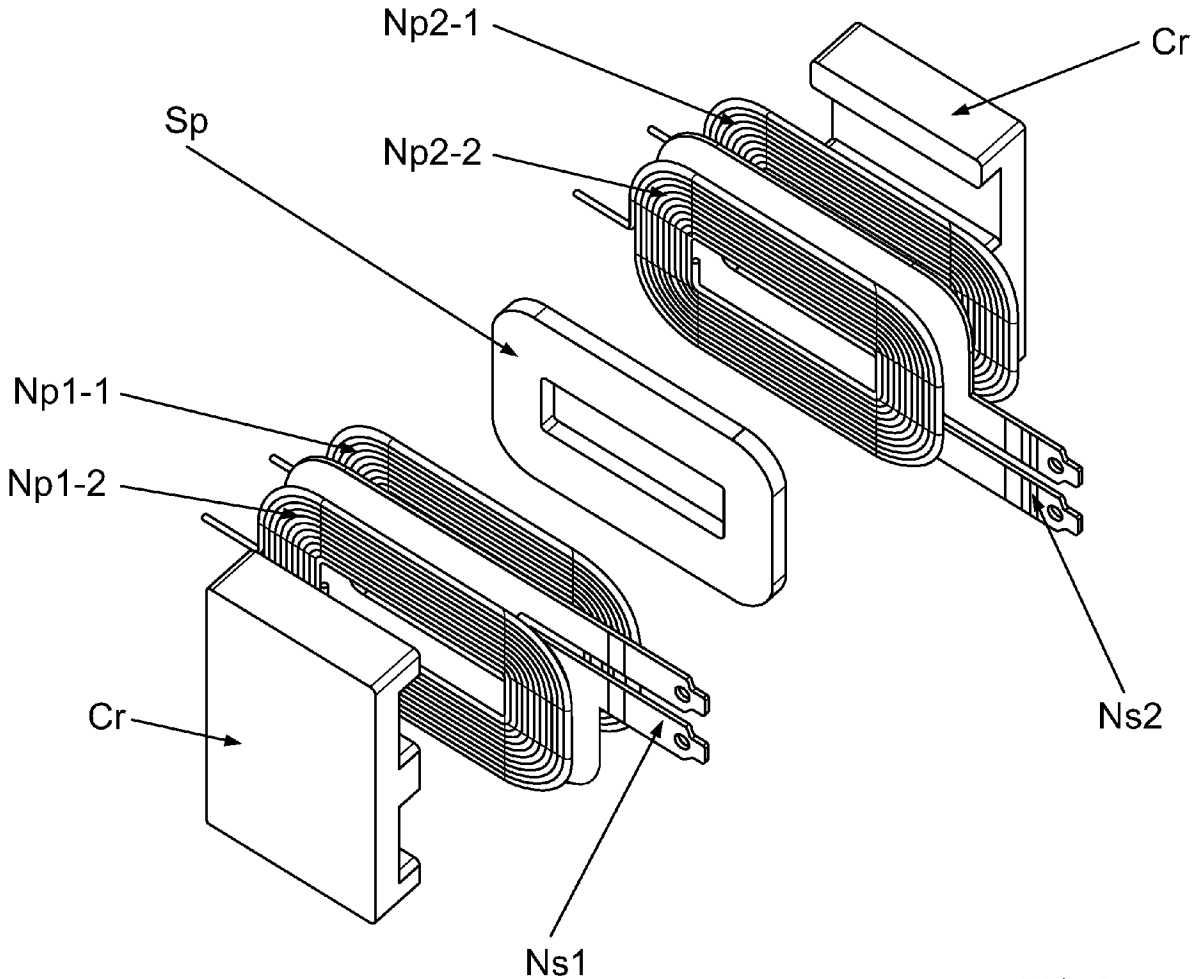
FIG. 9 illustrates an implementation of planar transformers in accordance with the present disclosure.

In modern, high efficiency and high density power supplies, planar transformer geometry is used to achieve sleek, low profile assemblies. This also allows a robust and repeatable transformer construction. FIG. 9 illustrates an implementation of planar transformers in accordance with the present disclosure. The planar 'E' core is represented by Cr. Ns1 and Ns2 represent the single turn copper stamping for the secondary, Np1-1, Np1-2, Np2-1 and Np2-2 represent the split primary windings in accordance with the description and illustrations in FIG. 6 and FIG. 7. SP represents the separator between the windings.

The construction of a center tapped transformer in accordance with the present disclosure can be applied to any type of push pull converter which uses center tapped windings for output rectification and has continuous/discontinuous current in the secondary windings. For instance, the construction in accordance with this disclosure can be applied to LLC resonant converters, fixed frequency resonant bus converters, forced resonant bus converters, fixed frequency continuous mode bus converters, phase shifted zero voltage switching full bridge converter, PWM controlled push pull or bridge converters and the like and consequently, power supply units using transformers in accordance with the present disclosure can be realized.

An actual bench test prototype in line with the connection diagram illustrated in FIG. 6 was used to construct a Half Bridge Forced Resonant Bus Converter to deliver an output power of 800 W with an output voltage of 12V at 67 A. A planar geometry using EE32×20×6 cores (two cores stacked together in each power rail) was chosen. The converter was basically an isolated bus converter which provides a step down function with galvanic isolation but does not have the capability to regulate the output voltage. Such two planar transformers were used to build the forced resonant converter each operating 90 degree output of phase with respect to each other. Each secondary winding (Ns1 and Ns2) was made up of only a single turn using a stamped copper sheet. The primary winding had 12 turns to achieve 12:1 turns ratio for a half bridge primary configuration.

The primary winding Np1 was made up of two identical windings, Np1-1 and Np1-2, each consisting of 12 turns. Similarly, the primary winding Np2 was also made up of two identical windings, Np2-1 and Np2-2, each consisting of 12 turns. The primary windings Np1-1 and NP1-2 were connected in parallel to form Np1. Similarly, the primary windings Np2-1 and Np2-2 were connected in parallel to form Np2. Finally, the primary windings Np1 and Np2 were connected in parallel for its connection to the half bridge switches (not shown).

When one secondary winding is short circuited, the inductance measured at the primary windings Np1 and Np2 were vastly different. At the primary winding which is closely coupled to the secondary which is being shorted, the measured leakage inductance was 3.5 micro Henry while the same measured at the loosely coupled primary was 9.9 micro Henry.

Broad specifications of the test converter were as follows:

Vin=300V DC approx.

Vout=12V

Iout=67A

Fsw=100kHz

The converter efficiency was about 98% at half load and about 97% at full load.

Figure 10:
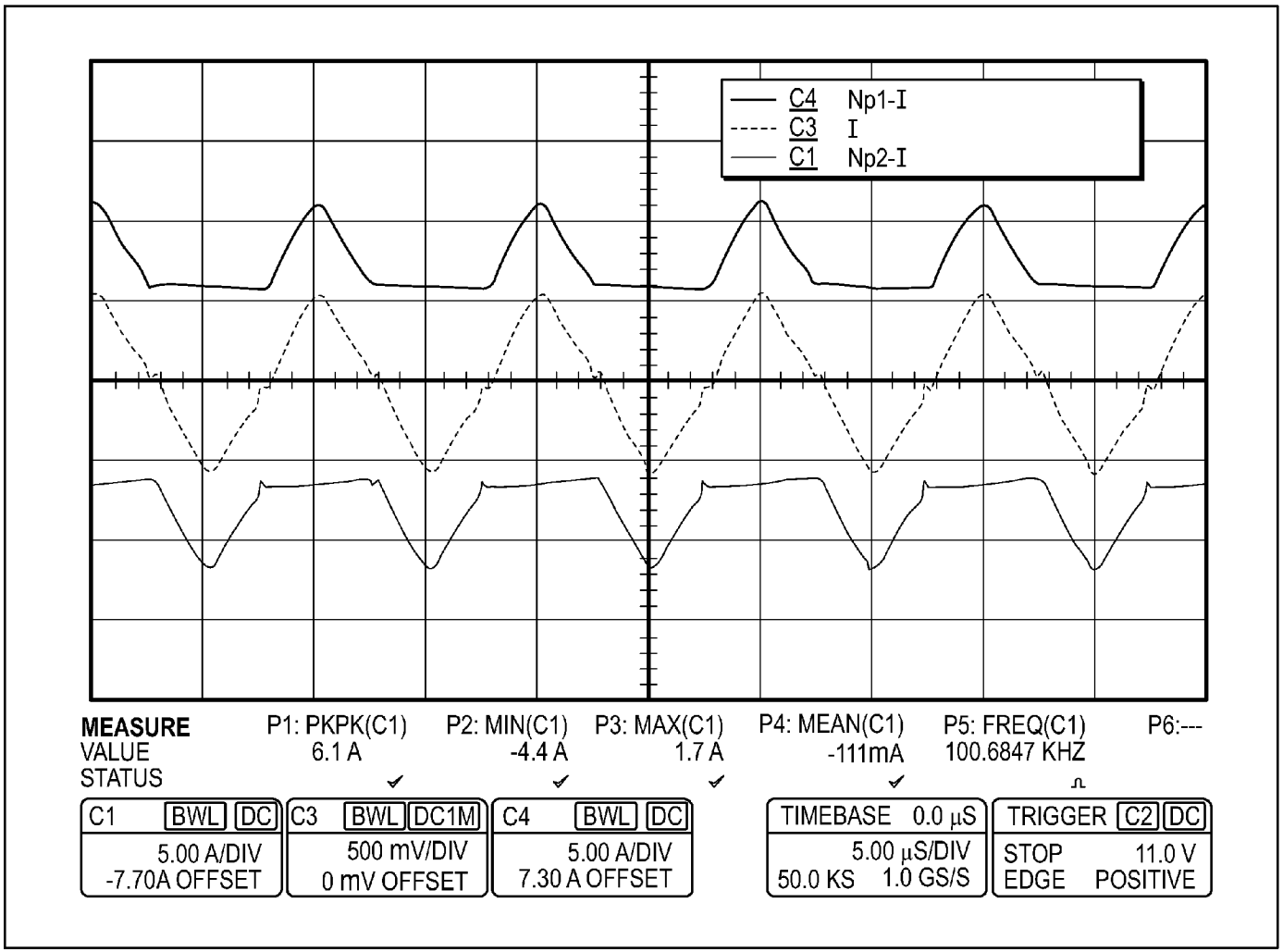
FIG. 10 illustrates an oscilloscope capture of the waveforms of primary current Versus time graph obtained in a converter with a planar transformer of FIG. 9.

FIG. 10 illustrates an oscilloscope capture of the waveforms of primary current Versus time graph obtained as a result of actual bench testing in accordance with the winding connection for center tapped transformers illustrated in FIG. 6 and described herein above. The individual current in the primary winding Np1 is represented by Np1-I and that in the primary winding Np2 is represented by Np2-I at full load. The total sum of primary currents after the junction of the half bridge (not shown) when they are paralleled is represented by I.

The waveforms clearly indicate that the entire reflected primary load current flows only in one primary winding which is properly coupled to the conducting secondary winding. The other primary winding carries only half of the magnetizing current. Thus, the non conducting secondary does not have much electric field around it and this also shows a large DC component of current in primary which significantly reduces the AC losses as well and allows use of thicker wire to reduce DC current related losses.

When probed at the combination of primary windings Np1 and Np2, after paralleling the two windings, the full combined AC current is seen as expected in the doubled ended push pull converter topology. This combined current is exactly the sum of the currents in the primary windings Np1 and Np2.

The current in each of the primary windings Np1 and Np2 looks like the current in a single ended converter, although it is a double ended converter. Thus this construction in accordance with the present disclosure offers the simplicity of a single ended transformer while exploiting twice the flux swing as in double ended transformers.

The results of the simulation using Ansoft tool demonstrated that peak transformer efficiency is about 99.25% at half load condition. At full load, the transformer has more than 99% efficiency. This implies an improvement in efficiency of about 0.5% to 0.7% over prior art transformers without any added cost.

Table-1 shows the efficiency test results obtained as a result of the simulation described herein above, wherein Vin and Vo represent the input and output voltage respectively in Volts; Iin and Io represent the input and output current respectively in Amperes; and Pin and Po represent the power input and output respectively in watts.

TABLE 1

| Vin(V) | Iin(A) | Pin(W) | Vo(V) | Io(A) | Po(W) | Efficiency(%) |
|---|---|---|---|---|---|---|
| 294.04 | 2.82 | 830.37 | 12.00 | 67.06 | 804.72 | 96.91 |
| 293.57 | 2.53 | 742.73 | 12.01 | 60.06 | 721.32 | 97.12 |
| 292.78 | 2.28 | 667.25 | 12.01 | 54.06 | 649.26 | 97.30 |
| 291.89 | 1.99 | 579.69 | 12.01 | 47.05 | 565.07 | 97.48 |
| 290.99 | 1.69 | 492.65 | 12.01 | 40.06 | 481.12 | 97.66 |
| 290.14 | 1.42 | 411.71 | 12.00 | 33.54 | 402.48 | 97.76 |
| 289.73 | 1.14 | 331.45 | 12.01 | 27.03 | 324.63 | 97.94 |
| 288.96 | 0.85 | 245.90 | 12.01 | 20.04 | 240.68 | 97.88 |
| 287.84 | 0.56 | 160.61 | 12.00 | 13.04 | 156.48 | 97.43 |
| 287.22 | 0.31 | 88.18 | 12.01 | 7.03 | 84.43 | 95.75 |
| 286.80 | 0.18 | 51.91 | 12.01 | 4.03 | 48.40 | 93.24 |

A center tapped transformer as described in this disclosure has several technical advantages including but not limited to the realization of:

a low cost solution for construction;

a higher efficiency than prior art transformers;

use of thicker wires for primary and secondary windings;

minimized winding proximity losses;

relatively high efficiency at high frequencies;

low voltage spikes; and tight and equal coupling of each secondary winding with the primary winding.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A center tapped power transformer comprising:

at least two identical sets of windings, said sets of windings having identical number of turns and structure to achieve identical coupling coefficients, said sets of windings being spaced apart from each other;

each of said sets of windings including at least one primary winding and at least one secondary winding, said at least one primary winding being coupled to said at least one secondary winding by placing the primary and secondary windings abutting each other;

the primary windings of each of said sets of windings connected in parallel; and a magnetic field isolating separator placed in the space between said sets of windings so that an electromagnetic coupling between said sets of windings is less than an electromagnetic coupling between the at least one primary winding and the at least one secondary winding of each of said sets of windings;

wherein the at least one secondary winding of a first one of said sets of windings is configured not to conduct current when the at least one secondary winding of a second one of said sets of windings is conducting current, the at least one secondary winding of the first one of said sets of windings experiencing substantially no current field and substantially no proximity losses due to induced eddy currents when the at least one secondary winding of the second one of said sets of windings is conducting current.

2. The center tapped power transformer of claim 1 wherein said at least one primary winding of each of said sets of windings is coupled to said at least one secondary winding by sandwich winding.

3. The center tapped power transformer of claim 1 wherein said at least one primary winding of each of said sets of windings is split into at least two windings, each of said split windings are connected in parallel and have the same number of turns.

4. The center tapped power transformer of claim 1 wherein said at least one primary winding of each of said sets of windings is split into at least two windings, each of said split windings are connected in series and have the same number of turns.

5. The center tapped power transformer of claim 1 wherein said magnetic field isolating separator includes at least one layer of insulating tape.

6. The center tapped power transformer of claim 1 wherein said magnetic field isolating separator includes an electrical insulator having a width corresponding to a degree of decoupling between said sets of windings.

7. The center tapped power transformer of claim 1 wherein said magnetic field isolating separator includes a wall extending from a bobbin around which any of said sets of windings is wound.

8. The center tapped power transformer of claim 1 wherein said magnetic field isolating separator includes a wall extending from a bobbin around which all of said sets of windings is wound.

9. A power supply unit which includes the center tapped power transformer of claim 1.

10. A center tapped transformer for an isolated power converter, the transformer comprising:

a first primary winding;

a second primary winding connected in parallel with the first primary winding;

a first secondary winding; and a second secondary winding connected to the first secondary winding;

the first primary winding electromagnetically coupled to the first secondary winding, the second primary winding electromagnetically coupled to the second secondary winding, and the first primary winding coupled to the second primary winding with an electromagnetic coupling less than the electromagnetic coupling between the first primary winding and the first secondary winding and the electromagnetic coupling between the second primary winding and the second secondary winding;

wherein the first secondary winding is configured not to conduct current when the second secondary winding is conducting current, the first secondary winding experiencing substantially no current field around the first secondary winding and substantially no proximity losses due to induced eddy currents when the second secondary winding is conducting current.

11. The transformer of claim 10 further comprising an isolator positioned between the first primary winding and the second primary winding to reduce electromagnetic coupling between the first primary winding and the second primary winding.

12. The transformer of claim 10 wherein each of the first primary winding and the second primary winding includes a first subwinding and a second subwinding.

13. The transformer of claim 12 wherein the first subwinding of each of the first primary winding and the second primary winding is connected in parallel with its primary winding's second subwinding.

14. The transformer of claim 12 wherein the first subwinding of each of the first primary winding and the second primary winding is connected in series with its primary winding's second subwinding.

15. The transformer of claim 12 wherein the first secondary winding is sandwiched between the first subwinding and the second subwinding of the first primary winding and the second secondary winding is sandwiched between the first subwinding and the second subwinding of the second primary winding.

16. The transformer of claim 10 wherein the first primary winding is coupled to the second secondary winding with an electromagnetic coupling less than the electromagnetic coupling between the first primary winding and the first secondary winding and the electromagnetic coupling between the second primary winding and the second secondary winding;

and the second primary winding is coupled to the first secondary winding with an electromagnetic coupling less than the electromagnetic coupling between the first primary winding and the first secondary winding and the electromagnetic coupling between the second primary winding and the second secondary winding.

17. An isolated power converter including the transformer of claim 10.

18. A center tapped power transformer comprising:

at least two sets of windings;

each of said sets of windings including at least one primary winding and at least one secondary winding coupled to the at least one primary winding;

the primary windings of the at least two sets of windings connected in parallel;

an electromagnetic coupling between the at least two sets of windings being less than an electromagnetic coupling between the at least one primary winding and the at least one secondary winding of each of said sets of windings;

wherein the at least one secondary winding of a first one of said sets of windings is configured not to conduct current when the at least one secondary winding of a second one of said sets of windings is conducting current, the at least one secondary winding of the first one of said sets of windings experiencing substantially no current field and substantially no proximity losses due to induced eddy currents when the at least one secondary winding of the second one of said sets of windings is conducting current.

19. The transformer of claim 18 further comprising a magnetic field isolating separator positioned between said sets of windings.

* * * * *